United States Patent [19]

Overman et al.

[11] 4,221,863

[45] Sep. 9, 1980

[54] FORMATION OF SILVER HALIDE GRAINS IN THE PRESENCE OF THIOUREAS

[75] Inventors: Joseph D. Overman; Joseph J. Sheeto, Jr., both of Wilmington, Del.

[73] Assignee: E. I. Du Pont de Nemours and Company, Wilmington, Del.

[21] Appl. No.: 892,395

[22] Filed: Mar. 31, 1978

[51] Int. Cl.[2] ..... G03C 1/02

[52] U.S. Cl. ..... 430/567; 430/569; 430/596; 430/604

[58] Field of Search ..... 96/94 R, 107, 108

[56] References Cited

U.S. PATENT DOCUMENTS

| | | | |
|---|---|---|---|
| 3,447,927 | 6/1969 | Bacon et al. | 96/108 |
| 3,501,305 | 3/1970 | Illingsworth | 96/108 |
| 3,501,306 | 3/1970 | Illingsworth | 96/107 |
| 3,655,394 | 4/1972 | Illingsworth | 96/94 R |
| 3,772,031 | 11/1973 | Berry et al. | 96/108 |
| 3,817,756 | 6/1974 | Claes et al. | 96/94 R |
| 3,895,948 | 7/1975 | Shiba et al. | 96/107 |
| 4,057,429 | 11/1977 | Debrabandere et al. | 96/94 R |

OTHER PUBLICATIONS

Research Disclosure 16516, Jan. 1978, 4 pages.

Claes, et al. "Crystal Habit Modification of Agcl by Impurities Determining the Solvation," The Journal of Photographic Science, vol. 21 pp. 39–52.

"Proceedings of the Royal Photographic Society," Centenary Conference, London, 1953, pp. 37–42, published 1955, (OH–Yama).

*Primary Examiner*—Won H. Louie, Jr.

[57] ABSTRACT

A silver halide emulsion which is useful in photography is described. The silver halide grains are characterized by uniform and increased grain size and uniform crystal habit when a compound containing the =N—C(=S)—N= moiety is present during the formation of the grains in the precipitation and/or the ripening steps.

15 Claims, No Drawings

FORMATION OF SILVER HALIDE GRAINS IN THE PRESENCE OF THIOUREAS

DESCRIPTION

Technical Field

This invention relates to photographic silver halide emulsions. More particularly, this invention relates to preparation of photographic silver halide emulsions, and still more particularly to precipitation and ripening of silver halide emulsion grains in the presence of a growth agent.

BACKGROUND

Conventional silver halide emulsions are frequently prepared by means of one of two precipitation methods followed by a physical ripening period. In the single-jet precipitation method, silver nitrate solution is added to a solution containing a protective colloid and halide ions. Emulsions prepared by this method usually have large grains which vary considerably in their crystal habit and size distribution. However, this method is capable of producing large-grain sensitive emulsions. In the double-jet precipitation method, silver nitrate solution and soluble halide solution are added simultaneously to a solution containing a protective colloid. Emulsions prepared by this method under controlled conditions can have grains with a narrow size distribution, i.e., the emulsion is monodisperse and has a uniform crystal habit, e.g., predominantly regular grains which have no twin-plane stacking faults.

The use of ripening agents in the preparation of photographic silver halide emulsions by either of the foregoing methods is old in the art. Thus, silver halide grains have been precipitated and ripened in the presence of excess halide ion and/or ammonia to modify grain size, grain size distribution, and morphology. Such agents, however, restrict the pH or pAg range in which the silver halide grains can be formed. Furthermore, because ammonia is volatile, control of concentration of growth agent, and hence, control of silver halide grain formation, is difficult.

The use of thiourea and other compounds containing hetero atoms as physical ripening accelerators has been disclosed by Oh-Yama in *Proceedings of the Royal Photographic Society,* Centenary Conference, London, 1953, pp. 37–42, published 1955. Although such substances promoted increased grain size, they were reported to have no practical utility, because they also produced heavy fog in actual emulsions.

There remains, therefore, a need for agents which can be used to promote the growth of silver halide grains of increased and uniform size and uniform crystal habit, which agents can be used in the precipitation and/or ripening steps over a range of conditions of pH, pAg and temperature with ready control of their concentration and without undesirable effects on the photographic performance of the grains or of emulsions containing the grains.

DISCLOSURE OF INVENTION

In a process for the preparation of a photographic silver halide emulsion wherein silver halide grains are precipitated in a protective colloid by the reaction of a solution containing silver ions with a solution containing halide ions, and wherein the precipitation may be followed by physical ripening, silver halide grains of uniform and increased grain size and uniform crystal habit are obtained when the silver halide grains are formed in the presence of a thiourea derivative having one of the formulae:

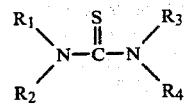
I

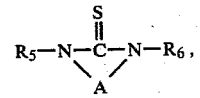
II

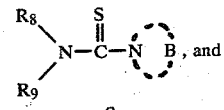
III

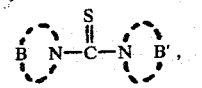
IV wherein:

$R_1$, $R_2$, $R_3$ and $R_4$ are either $C_1$–$C_6$ alkyl groups or substituted alkyl groups, provided, however, that (a) when any one of them has 5 or 6 carbon atoms, none of the others has more than 2 carbon atoms, and (b) when any two of them have 4 carbon atoms, none of the others has more than 2 carbon atoms;

$R_5$ and $R_6$ represent hydrogen or a $C_1$–$C_4$ alkyl group, which may be substituted;

A is $—CH_2—X—CH_2—$ wherein X is a carbon-carbon bond, $—CH_2—$, $—CH_2—CH_2—$,

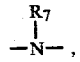

or —O—;

$R_7$ is hydrogen, an alkyl group having 1 to 12 carbon atoms, a cycloalkyl group having 5 or 6 carbon atoms, or —O—;

$R_8$ and $R_9$ are $C_1$–$C_3$ alkyl groups, which may be substituted;

B and B′ are $—CH_2—Y—CH_2—$ groups, provided, however, that when one of B or B′ contains an oxygen atom in its ring, the other may not; and Y is a carbon-carbon bond, $—(CH_2)_n—$ where n is 1 to 3, or

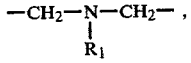

or $—CH_2—O—CH_2—$.

This thiourea derivative may be present during the precipitation or the ripening or both, and the substituents to the various "R groups", if any, should be substituents that do not impede or retard the complexing action of the thiourea moiety.

DETAILED DESCRIPTION OF THE INVENTION

The growth agents useful in this invention may be present during the precipitation step and/or the Ostwald ripening step in the formation of silver halide grains. The growth agents may be used in any of the methods of precipitating silver halide grains useful in making photographic silver halide emulsions, particularly in the single-jet and double-jet precipitation methods. During precipitation, the growth agents may be present in the solution containing the halide ion, the silver ion, the protective colloid, or any combination of such solutions. The growth agents may also be added after precipitation is complete and before Ostwald ripening of the silver halide grains.

The growth agents useful in the process of this invention are either tetra-alkyl-substituted thioureas or saturated heterocyclic compounds containing the thiourea moiety and being substantially free of labile sulfur. These growth agents have low volatility and are substantially chemically neutral. Consequently, their use does not affect pH during precipitation and ripening. A further advantage of the use of these growth agents is that the resulting emulsions exhibit reduced fog levels. Preferred grain-growth agents containing the thiourea moiety are illustrated by and include the following compounds:

I. Compounds having the general formula

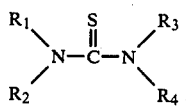

wherein $R_1$, $R_2$, $R_3$ and $R_4$ are alkyl groups which may be substituted with substituents that do not impede or retard the complexing action of the thiourea moiety and which may have from 1 to 6 carbon atoms, provided, however, that (a) when any one of them has 5 or 6 carbon atoms, none of the others may have more than 2 carbon atoms, and (b) when any two of them have 4 carbon atoms, none of the others may have more than 2 carbon atoms, e.g., 1,1,3,3-tetramethyl-2-thiourea
1,1,3,3-tetraethyl-2-thiourea
1,1,3,3-tetra-n-propyl-2-thiourea;

II. Compounds having the general formula

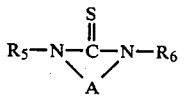

wherein $R_5$ and $R_6$ are hydrogen or alkyl groups which may be substituted with substituents that do not impede or retard the complexing action of the thiourea moiety and which may have from 1 to 2 carbon atoms; A is $—CH_2—X—CH_2—$; and X is a carbon-carbon bond, $—CH_2—$, $—CH_2CH_2—$,

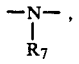

or —O—; and $R_7$ is hydrogen, an alkyl group having 1 to 6 carbon atoms, a cycloalkyl group having 5 or 6 carbon atoms, or —O—; e.g., imidazolidine-2-thione
1-methyl-imidazolidine-2-thione
1,3-dimethyl-imidazolidine-2-thione
1,3-diethyl-imidazolidine-2-thione
1,3-dimethyl-tetrahydro-(2 H)-pyrimidine-2-thione
1,3-diethyl-tetrahydro-(2 H)-pyrimidine-2-thione
3,5-dimethyl-tetrahydro-(4 H)-1,3,5-oxadiazine-4-thione
3,5-diethyl-tetrahydro-(4 H)-1,3,5-oxadiazine-4-thione
1-methyl-tetrahydro-(4 H)-1,3,5-triazine-4-thione
1-ethyl-tetrahydro-(4 H)-1,3,5-triazine-4-thione
1-cyclohexyl-tetrahydro-(4 H)-1,3,5-triazine-4-thione
1,3,5-trimethyl-tetrahydro-(4 H)-1,3,5-triazine-2-thione
1,3,5-triethyl-tetrahydro-(4 H)-1,3,5-triazine-2-thione;

III. Compounds having the general formula

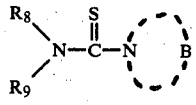

wherein $R_8$ and $R_9$ are alkyl groups which may be substituted with substituents that do not impede or retard the complexing action of the thiourea moiety and which may have from 1 to 3 carbon atoms; B is $—CH_2—Y—CH_2—$; and Y is a carbon-carbon bond, $—(CH_2)_n—$ where n is 1 to 3,

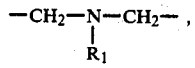

or $—CH_2—O—CH_2—$, and $R_1$ is as previously defined, e.g., dimethylamino-N-piperidyl-thiocarbonyl
diethylamino-N-piperidyl-thiocarbonyl; and IV. Compounds having the general formula

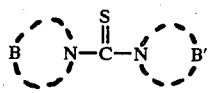

where B and B′ are both as previously defined for B, provided, however, that when one of them contains an oxygen atom in its ring, the other may not, e.g., N,N′-dipyrrolidyl-thiocarbonyl
N,N′-dipiperidyl-thiocarbonyl.

The amount of thiourea grain-growth agent to be used in a given instance will vary widely depending on such factors as the specific agent chosen, its solubility, the effect desired in the final grains, the precipitation conditions (e.g., pH, pAg, temperature), and the like. In general, the amount may range from 0.01 to 5 g of thiourea grain-growth agent per mole of silver halide, and preferably the amount will be from 0.02 to 1.5 g of thiourea grain-growth agent per mole of silver halide.

Silver halide grains which can be prepared using the growth agents of this invention include silver chloride, silver bromide, and mixed halides such as silver iodochloride, silver chlorobromide, silver iodobromide, and silver iodochlorobromide. In a particularly preferred aspect of the invention, monodisperse silver halide emulsions containing grains with a regular crystal habit are prepared in the presence of the thiourea grain-growth agents using the controlled double-jet precipitation method. This method comprises the steps of gradually and simultaneously adding a solution of silver ion and a solution of halide ion or ions to a solution containing a protective colloid, e.g., gelatin, and a thiourea grain-growth agent. The rate of addition of each solution is controlled or programmed to maintain the silver ion concentration in the protective colloid solution at a desired value or values during the precipitation. In this precipitation method, silver ion concentration generally is between a pAg of about 5 to about 11, and pH may be any desired value, usually below 7, and preferably between 4 and 7, since the thiourea grain-growth agents are substantially neutral. During precipitation, an additional halide ion may be present in the protective colloid solution or may be added simultaneously as a third solution to the protective colloid solution. After precipitation and any desired period of ripening, the emulsion is coagulated and washed by any of the well-known methods. At this point, AgBr emulsions may be washed with a soluble bromide solution to remove any of the remaining thiourea grain-growth agent. After washing further with water, the emulsion may then be conventionally digested, sensitized or fogged, and coated.

In the double-jet procedure, the thiourea grain-growth agent may alternatively be incorporated in the soluble silver ion solution or the soluble halide ion solution. Metal ions such as thallous, lead, rhodium, gold or other tri- or tetravalent heavy metal ions may be present during precipitation. Usually, such heavy metal ions will be present in the protective colloid solution but, when soluble, their salts may be present in either the silver ion solution or the halide ion solution.

Preferred emulsions produced by the double-jet precipitation method are monodisperse and predominantly contain regular emulsion grains. Regular silver halide emulsion grains are silver halide crystals having no twin-plane stacking faults, such as grains having cubic, octahedral, tetradecahedral, and the like crystal habits. Monodisperse silver halide emulsions are emulsions having a narrow grain-size distribution, i.e., emulsions in which a predominant number of grains have substantially the same size or volume. For the purpose of this invention, the grain-size distribution may be expressed by $\alpha$ values, defined and determined as described on page 76 of Mees-James, "The Theory of the Photographic Process", The Macmillan Company, New York (1966). Thus, $\alpha$is "the projection on the log size axis of the straight line portion of the percentage cumulative curve of the distribution extended to 0% and 100%" and a monodisperse emulsion is an emulsion wherein $\alpha$ is about 0.5 or less. Grain size and grain-size distribution may be determined by the electrolytic reduction method described by Holland and Sawers in *Photographic Science and Engineering,* 17, 295–8 (1973).

Silver halide emulsions may also be prepared using the thiourea growth agents of this invention by means of the single-jet precipitation method. This method comprises the addition of a soluble silver salt solution to a solution containing a protective colloid, e.g., gelatin, a soluble halide salt and a thiourea growth agent. After the initial addition of silver salt solution, the resulting emulsion may be ripened or the precipitation may be continued by consecutively adding solutions of halide ion and silver ion. The halide may be the same halide initially present or a different halide ion. After precipitation and any desired period of ripening, the emulsion may be coagulated or precipitated, and washed by any of the well-known methods. The emulsion may also be washed with a soluble bromide salt solution. After washing, the emulsion may be conventionally digested, sensitized or fogged, and coated. During precipitation, the thiourea growth agents may alternatively be present in the added silver salt solution. Also, the precipitation may be carried out where desired in the presence of heavy metal ions such as thallous, lead, rhodium, gold or other tri- or tetravalent metal ions.

The use of the thiourea grain-growth agents is not limited to the above-described precipitation methods, but extends to any silver halide precipitation method where control of grain growth is desired.

Emulsions prepared using thiourea grain-growth agents according to this invention are useful in a variety of applications, e.g., in radiographic film, lithographic film, direct print film, direct positive film, and the like. Generally, only a single thiourea grain-growth agent is required during emulsion preparation; however, more than one thiourea grain-growth agent may be used where desired. Similarly, the thiourea grain-growth agents may be used in conjunction with other conventional grain-growth agents.

In place of gelatin, other natural or synthetic water-permeable organic colloid binding agents can be used. Such agents include water-permeable or water-soluble polyvinyl alcohol and its derivatives, e.g., partially hydrolyzed polyvinyl acetates; polyvinyl ethers and acetals containing a large number of extralinear —$CH_2$-CHOH— groups; hydrolyzed interpolymers of vinyl acetate and unsaturated addition-polymerizable compounds such as maleic anhydride, acrylic and methacrylic acid ethyl esters, and styrene. Other useful binder components are the anhydride-modified hydrolyzed gelatins.

Sulfur sensitizers containing labile sulfur, e.g., allyl isothiocyanate, allyl diethyl thiourea, phenyl isothiocyanate and sodium thiosulfate, may be used, as well as the polyoxyalkylene ethers and the polyglycols. Other nonoptical sensitizers may also be used, such as amines and metal salts.

Fogging agents useful in preparing direct positive emulsions include amine boranes, boron hydrides, tin, gold, and other reduction agents.

The emulsions can contain known antifoggants, e.g., 6-nitrobenzimidazole, benzotriazole, triazaindenes, etc., as well as the usual hardeners, e.g., chrome alum, formaldehyde, dimethylol urea, mucochloric acid, etc. Other emulsion adjuvants may include matting agents, plasticizers, toners, optical brightening agents, surfactants, and the like.

The invention will be further illustrated by the examples that follow, wherein parts and percentages are by weight unless otherwise indicated. Example 1 represents the best mode contemplated by the invention. Except where specifically noted, the emulsions of the examples were not sensitized. Grain sizes are given as average grain volume, $\overline{V}$ in $um^3$, and grain-size distribution is given as $\alpha$ according to the definition given in the Mees-James text previously mentioned; both properties are reported on the basis of observations by optical micrographs, electron micrographs, or the electrolytic reduction method of Holland and Sawers previously referenced. Speed, fog and $D_{max}$ were obtained by conventional sensitometric procedures i.e., by exposing film samples through a $\sqrt{2}$ step tablet to a 0.01-second xenon flash [EG&G Sensitometer, Mark VI, made by Edgerton, Germeshausen & Grier, Inc., Boston, Mass.] then developing the films in conventional continuous-tone developers of the metol/hydroquinone or phenidone/ascorbic acid variety.

EXAMPLE 1

A photographic film having a monodisperse regular silver iodobromide emulsion was prepared by the double-jet precipitation method using a thiourea grain-growth agent according to this invention from three solutions having the following compositions:

Solution I

Photographic gelatin: 33.6 g
1,3-dimethyl-imidazolidine-2-thione: 0.9 g
Water: 1120 ml Solution II Silver nitrate (3N solution): 700 ml Solution III Potassium bromide (3N solution): 691.6 ml
Potassium iodide (3N solution): 8.4 ml Solution II and Solution III were simultaneously added to Solution I over a period of 45 minutes while Solution I was vigorously stirred. During the addition, the precipitation medium, i.e., Solution I, was maintained at 52° C. pAg of ~8.5 and pH of ~6.1. After precipitation, the emulsion was chilled, coagulated with polyvinyl alcohol o-sulfobenzaldehyde acetal, and excess solution was decanted. The emulsion was then redispersed with the addition of 165 g of gelatin and 25 ml of a ~10% solution of saponin in water/alcohol, then pH and pAg were adjusted to 6.2 and ~9.3 respectively.

A portion of the unsensitized emulsion so prepared was conventionally coated on polyethylene terephthalate film base having a gel-and-resin sub.

A second portion of the emulsion, containing 0.3 mole of silver ion, was readjusted to a pH of 6.4 and a pAg of ~8.4 and there were then added 0.001 g of sodium aurous thiosulfate, 0.00002 g of sodium thiosulfate, and 0.00004 g of mercuric chloride. After the emulsion had been digested at ~60° C. for 40 minutes, there were added an additional 4 ml of the ~10% saponin solution and an antifoggant of the triazoindolizine class, and the emulsion was conventionally coated on a polyethylene terephthalate film base of the kind just described.

Comparison A, a sample containing no growth agent, was prepared in the same manner as Example 1 except that the 1,3-dimethyl-imidazolidine-2-thione was omitted, and the emulsion was not sensitized before coating on polyethylene terephthalate film base.

Comparison B, a sample containing a prior art growth agent, ammonia, was prepared in the same manner as Example 1 except that the 0.9 g of 1,3-dimethylimidazolidine-1-thione was replaced with 0.45 g of 28.4% $NH_4OH$ and pH and pAg were maintained at 8.96 and ~8.5 respectively during the precipitation. The resulting emulsion was not sensitized before coating on polyethylene terephthalate film base.

Grain measurements and sensitometric characteristics of the four films are given in Table 1.

Table 1

| | $\bar{V}$, $\mu m^3$ | $\alpha$ | Relative Speed | Fog Density |
|---|---|---|---|---|
| Example 1, unsensitized | 0.078 | 0.19 | 434 | 0.01 |
| Example 1, sensitized | 0.078 | 0.19 | 1500 | 0.02 |
| Comparison A | 0.001 | 0.3 | 40 | 0.01 |
| Comparison B | 0.016 | 0.32 | 40 | 0.01 |

By the use of the thiourea grain-growth agent according to this invention, grain size, grain-size uniformity, and speed were all increased with no increase in fog, as compared with samples containing either no growth agent or ammonia, a prior art growth agent.

EXAMPLES 2–11

These examples illustrate emulsions and films made with other thiourea grain-growth agents according to this invention. The procedures of Example 1 were followed and the solutions of Example 1 were used, except that the growth agent of that example was replaced by a number of other growth agents according to this invention. Table 2 identifies the growth agents, shows the amount of each used, and indicates the effects on grain growth and sensitometric characteristics. Data for Comparisons A and B of the preceding example are included for easy reference.

Table 2

| Example | Grain-Growth Agent |
|---|---|
| Comparison A | None |
| Comparison B | $NH_4OH$ |
| Comparison C | 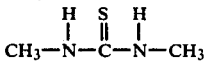 1,3-dimethyl thiourea |
| 2 | 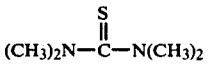 1,1,3,3-tetramethyl thiourea |
| 3 | 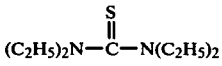 1,1,3,3-tetraethyl thiourea |
| 4 | 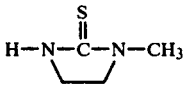 1-methyl-imidazolidine-2-thione |
| 5 | 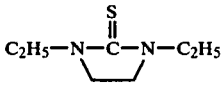 1,3-diethyl-imidazolidine-2-thione |
| 6 | 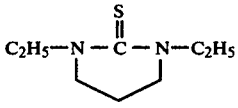 1,3-diethyl-tetrahydro-(2H)-pyrimidine-2-thione |
| 7 | 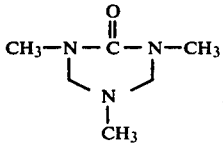 1,3,5-trimethyl-tetrahydro-(2H)-1,3,5-triazine-2-thione |
| 8 | 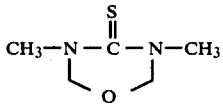 3,5-dimethyl-tetrahydro-(4H)-1,3,5-oxadiazine-4-thione |
| 9 | 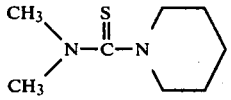 dimethylamino-N-piperidyl-thiocarbonyl |
| 10 | 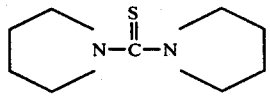 N,N'-dipyrrolidyl-thiocarbonyl |

Table 2-continued

11

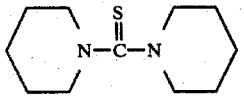

N,N'-dipiperidyl-thiocarbonyl

| Example | Millimoles per Mole Silver | $\bar{V}$, $\mu m^3$ | $\alpha$ | Relative Speed | Fog Density |
|---|---|---|---|---|---|
| Comparison A | — | 0.001 | 0.3 | 40 | 0.01 |
| Comparison B | 1.7 | 0.016 | 0.32 | 40 | 0.01 |
| Comparison C | 3.6 | 0.013 | 0.54 | — | Totally fogged |
| 2 | 3.3 | 0.020 | 0.21 | 154 | 0.01 |
| 3 | 4.0 | 0.0125 | 0.176 | 55 | 0.01 |
| 4 | 3.6 | 0.005 | 0.44 | 268 | 0.01 |
| 5 | 3.3 | 0.072 | 0.30 | 401 | 0.01 |
| 6 | 3.3 | 0.062 | 0.29 | 205 | 0.01 |
| 7 | 3.3 | 0.140 | 0.19 | 706 | 0.03 |
| 8 | 3.2 | 0.038 | 0.22 | 203 | 0.01 |
| 9 | 3.3 | 0.255 | 0.23 | 268 | 0.01 |
| 10 | 3.2 | 0.051 | 0.25 | 194 | 0.01 |
| 11 | 3.3 | 0.012 | 0.29 | 54 | 0.01 |

It will be seen that all of the agents according to this invention contributed to significant grain growth and significant increases in grain-size uniformity and speed with no increase in fog, all as compared with (a) Comparison A, a sample with no growth agent, (b) Comparison B, a sample with a prior art growth agent, and (c) Comparison C, a dialkyl-substituted thiourea otherwise structurally identical to the tetraalkyl-substituted compounds of general formula I of this invention.

EXAMPLES 12–19

These examples show the effect of varying the concentration of the thiourea grain-growth agent. The procedures, compositions and amounts of Example 1 were used, except that the concentration of the thiourea grain-growth agent, 1,3-dimethyl-imidazolidine-2-thione, was varied as indicated in Table 3, which also shows the effects on grain growth. Data for Comparison A (no grain-growth agent) and Example 1 are included for easy reference.

Table 3

| Example Comparison | Growth Agent g | Millimoles per Mole Silver | $\bar{V}$, $\mu m^3$ | $\alpha$ |
|---|---|---|---|---|
| A | None | None | 0.001 | 0.3 |
| 12 | 0.05 | 0.18 | 0.0023 | 0.41 |
| 13 | 0.19 | 0.7 | 0.0052 | 0.3 |
| 14 | 0.3 | 1.1 | 0.014 | 0.19 |
| 15 | 0.39 | 1.4 | 0.018 | 0.25 |
| 16 | 0.5 | 1.83 | 0.0235 | 0.26 |
| 17 | 0.8 | 2.93 | 0.056 | 0.257 |
| 1 | 0.9 | 3.3 | 0.078 | 0.19 |
| 18 | 1.0 | 3.66 | 0.11 | 0.27 |
| 19 | 1.2 | 4.4 | 0.18 | 0.4 |

EXAMPLES 20–25

These examples illustrate the effect of pH during precipitation on grain size. The compositions and amounts of Example 1 were used, i.e., 0.9 g of 1,3-dimethyl-imidazolidine-2-thione as grain-growth agent according to this invention, and the procedures of Example 1 were followed except that dilute NaOH was added as required to adjust pH to the levels indicated in Table 4, where effect on grain volume and grain-size uniformity are also shown. These examples show that, while grain growth is promoted by raising pH to levels at least as high as 9.5, it is preferable to operate at pH of 7 or less to avoid possible development of fog.

Table 4

| Example | pH | $\bar{V}$, $\mu m^3$ | $\alpha$ | Fog |
|---|---|---|---|---|
| 20 | 2.0 | 0.0009 — 0.006* | * | None |
| 21 | 3.0 | 0.004 | 0.45 | None |
| 22 | 4.0 | 0.08 | 0.26 | None |
| 1 | 6.2 | 0.078 | 0.19 | None |
| 23 | 7.0 | 0.069 | 0.22 | Slight |
| 24 | 8.0 | 0.073 | 0.23 | Appreciable |
| 25 | 9.0 | 0.12 | 0.15 | Appreciable |

*Grain-size determination by the electrolytic reduction method showed a plurality of peaks at $\bar{V}$ = 0.00092, 0.0048, 0.0058 and 0.0062 $\mu m^3$, but with excellent monodispersity, i.e., very narrow peaks, in each particle size range.

EXAMPLE 26

This example illustrates the effect of adding a grain-growth agent for ripening, rather than having it present during precipitation. The precipitation procedure of Example 1 was repeated except that the 0.9 g of 1,3-dimethyl-imidazolidine-2-thione was omitted from Solution I. At the end of the precipitation step and before the coagulation/wash steps, there was added 1.2 g of 1,3-dimethyl-imidazolidine-2-thione [4.4 millimoles per mole of silver], and the emulsion was allowed to stir for 40 minutes. Grain-size determinations were made for samples of the emulsion taken as follows:

| Time from addition of growth agent | $\bar{V}$, $\mu m^3$ | $\alpha$ |
|---|---|---|
| (a) Before addition | 0.00085 | 0.3 |
| (b) 20 minutes after addition | 0.0011 | 0.6 |
| (c) 40 minutes after addition | 0.0018 | 0.66 |

The pAg was raised to ~9.3 with potassium bromide, and the emulsion was chilled rapidly, coagulated and washed by procedures like those previously described. The coagulated grains were redispersed and conventionally coated on gel-and-resin subbed polyethylene terephthalate film base. The exposed and developed film had extremely low fog.

EXAMPLE 27

A silver bromide photographic emulsion was prepared with a thiourea grain-growth agent according to this invention by the balanced double-jet precipitation technique from the following compositions:

Solution I

| | |
|---|---|
| Photographic gelatin | 4 g |
| Distilled water | 180 ml |
| Ethylene thiourea | 0.07 g [= 5.1 millimoles/mole Ag] |

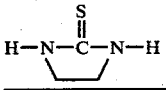

Solution II

Silver nitrate (3N): 45 ml

Solution III

Potassium bromide (3N): 45 ml

Solution II and Solution III were added simultaneously to Solution I over a period of 40 minutes while Solution I was vigorously stirred. Precipitation conditions were maintained at a temperature of ~70° C., a pH of ~6.2 and a pAg of ~7.3. The emulsion was then chilled and coagulated as described in Example 1. There was evidence of grain growth, but reliable determination of grain size was made difficult because of severe clumping or agglomeration of the grains.

The preparation was repeated by essentially the same procedures except that (a) the amount of ethylene thiourea was increased to 0.1 g [7.3 millimoles/mole Ag], (b) precipitation time was 42 minutes, and (c) at the end of precipitation, sufficient potassium bromide was added to bring pAg to ~9.3. After the emulsion was cooled, coagulated and washed as before, electron micrographs showed grains with $\overline{V}$=~0.015 $\mu m^3$ and with no severe clumping.

EXAMPLE 28

This example illustrates a photographic silver bromide emulsion made with a thiourea grain-growth agent of this invention by the double-jet precipitation procedure at relatively high pAg and with two different flow rates of solutions employed in the course of the precipitation. The following compositions were used:

Solution I

Photographic gelatin: 33.6 g
1,3-dimethyl-imidazolidine-2-thione: 1.75 g [=6.4 millimoles/mole Ag]
Water: 1120 ml

Solution II

Silver nitrate (3N): 700 ml

Solution III

Potassium bromide (3N): 700 ml

To Solution I prior to the precipitation, there was added sufficient 3N potassium bromide to provide an excess of halide ions (pAg=~9.1). Solution II and Solution III were then added simultaneously over a period of 48 minutes while Solution I was vigorously stirred. The initial flow rates of Solutions II and III were maintained at ~6 ml/min. for 7.66 minutes and were then increased to ~13.3 ml/min. for the remainder of the precipitation period. Precipitation conditions were maintained at a temperature of 52° C. and a pAg of ~9.0. After the precipitation was complete, the emulsion was chilled and coagulated by the procedure of Example 1. The average grain volume from electron microscopy was $\overline{V}$=~0.19 $\mu m^3$.

EXAMPLE 29

This example illustrates the use of a thiourea grain-growth agent in precipitating a different silver halide from those of the preceding examples. A photographic film having a regular silver bromochloride emulsion was prepared by the double-jet precipitation method from solutions of the following compositions:

Solution I

Photographic gelatin 10 g
1,3-dimethyl-imidazolidine-2-thione:0.125 g [=2.56 millimoles/mole Ag]
Water: 500 ml

Solution II

Silver nitrate (1.5 N): 250 ml

Solution III

Sodium chloride (1.5 N): 200 ml
Sodium bromide (1.5 N) 86 ml

Solution II and Solution III were simultaneously added to Solution I over a period of 24 minutes while Solution I was vigorously stirred. During the addition, the precipitation conditions were maintained at a temperature of 48° C., a pH of 5.5 and a pAg of 7.5. After precipitation was complete, the emulsion was chilled, coagulated and washed as described in Example 1. The emulsion was then redispersed with the addition of 70 g of gelatin and pH and pAg were adjusted to 5.3 and 7.5 respectively. In a conventional manner, saponin was added as a coating aid and the emulsion was coated on subbed polyethylene terephthalate film base of the kind described in Alles U.S. Pat. No. 2,779,684.

Comparison D was prepared from the same materials and by the same procedures except that the thiourea grain-growth agent was omitted from Solution I. Comparative data on grain size and sensitometric characteristics for the two samples are given in Table 5.

Table 5

| Property | Example 29 | Comparison D |
|---|---|---|
| Grain shape | Spheres | Cubes |
| Grain size, $\overline{V}$, $\mu m^3$ | 0.19 | 0.01 |
| Relative Speed | 17.5 | 1 |
| $D_{max}$ | >4 | 0.46 |
| Fog Density | 0.05 | 0.06 |

EXAMPLE 30

This example illustrates the use of a relatively large amount of a thiourea grain-growth agent in precipitating still another silver halide. A photographic emulsion having monodisperse silver chloride grains was prepared in the presence of the thiourea grain-growth agent of Example 1. A protective colloid solution of 30 g of photographic gelatin and 0.4 g 1,3-dimethyl-imidazolidine-2-thione [10.2 millimole per mole Ag] in 200 ml water was prepared and brought to a temperature of 50° C. and a pH of 5.5. To the stirred protective colloid solution there were simultaneously added over a period of 20–25 minutes 100 ml of 3N silver nitrate solution and 100 ml of 3N potassium chloride solution. The precipitation conditions were maintained constant at a temperature of 50° C. and a pAg of 8.1. When precipitation was complete, the emulsion was cooled, coagulated and washed as described for previous examples. The procedure was found to yield very large silver chloride grains with $\overline{V}$=5.6 $\mu m^3$.

EXAMPLE 31

This example illustrates the use of a thiourea grain-growth agent in the preparation of still another silver halide, a photographic silver iodochlorobromide emulsion, by the single-jet or splash precipitation method. A protective colloid solution was prepared from 455 ml of water, 20 g of photographic gelatin, 154 g of ammonium bromide and 2 g of 1,3-dimethyl-imidazolidine-2-thione. To the stirred protective colloid solution, adjusted to a pH of 3.0 and maintained at a temperature of 44.4° C., there was added one liter of 0.6N silver nitrate solution at ambient temperature over a period of 90 seconds.

After 5 minutes from the beginning of the first addition, there was added 36 ml of 0.5N potassium iodide solution with continued stirring of the mixture, followed within 30 seconds by the addition of 60 ml. of 2.7 N potassium chloride solution. Within 30 seconds of the potassium chloride addition, there were added 596 ml of 1.5N silver nitrate solution at a rate of 25 ml/min. At the completion of the silver nitrate addition, the emulsion was ripened for 5 minutes, then cooled, coagulated and washed as described in Example 1. Properties of the resulting grains were found to be $\overline{V}=1.6\ \mu m^3$ and $\alpha=0.28$.

EXAMPLE 32

This example illustrates the use of a thiourea grain-growth agent in the preparation of a direct positive emulsion. Monodisperse silver iodobromide (1.2 mol % $I^-$) grains were precipitated according to the procedure and with the compositions of Example 1 except that (a) Solution I contained 0.34 g of 1,3-dimethyl-imidazolidine-2-thione [1,24 millimole/mole Ag], and (b) Solution II contained 0.06 g rhodium nitrate. Properties of the resulting grains were $\overline{V}=0.0115\ \mu m^3$ and $\alpha=0.176$. The grains were redispersed in inert gelatin (23 g/mole Ag halide), and the emulsion was conventionally fogged with a gold compound and a thiaborane, then treated with a desensitizing dye of the imidazoquinoxalinium class, and coated on a resin-subbed polyethylene terephthalate film base. When exposed to tungsten light through a positive transparency and then developed in a metol/hydroquinone developer, the film gave a direct positive image of the transparency.

EXAMPLE 33

This example illustrates the use of a thiourea grain-growth agent in precipitating silver halide grains in a protective colloid other than gelatin. A photographic silver chloroiodobromide emulsion was prepared by the double-jet precipitation method from the following compositions:

Solution I

Distilled water: 400 ml
Aqueous colloidal silica sol: containing ~30% $SiO_2$ 40 ml

Solution II

Ammonium bromide (3N): 550 ml
Potassium iodide (0.5N): 60 ml
Potassium chloride: 10 g

Solution III

Silver nitrate (3N): 500 ml

To Solution I, heated to 46° C., there was added 1.2 g of 1,3-dimethyl-imidazolidine-2-thione, and the pH was adjusted to 2.5 with dilute sulfuric acid. The pAg was adjusted to 7.8 with 0.1N silver nitrate solution, and Solution II and Solution III were added simultaneously at a rate of 2 ml/min. After 15 minutes, the flow rate of the two solutions was increased to 10 ml/min. When precipitation was complete, the temperature was reduced to 35° C. and the grains were allowed to settle out. After the addition of acidified wash water, the emulsion was stirred for 5 minutes then centrifuged to isolate the silver halide grains, which were found to have the properties $\overline{V}=0.83\ \mu m^3$ and $\alpha=0.163$.

When reference is made in the foregoing Examples to coating the silver halide emulsion upon a polyethylene terephthalate film base having a gel-andresin sub, this refers to a polyethylene terephthalate film base coated with two subbing layers, the layer which is in direct contact with the film base being a vinylidene chloride/itaconic acid copolymer, and the next layer being a gelatin coating which provides good adhesion to the photosensitive gelatino-silver halide emulsion to be coated thereon. The resulting film base offers exceptionally good dimensional stability. Of course, other transparent plastic film supports may be used, such as cellulose acetate, cellulose triacetate, polystyrene, polymeric acrylates, etc. Also, various opaque film supports may be used, such as paper, regenerated cellulose, and other opaque polymeric supports.

We claim:

1. In a process for the preparation of a monodisperse photographic silver halide emulsion wherein silver halide grains are precipitated in a protective colloid by the reaction of a solution containing silver ions with a solution containing halide ions, the improvement comprising the steps of (1) forming the silver halide grains in the presence of a thiourea derivative having one of the formulae:

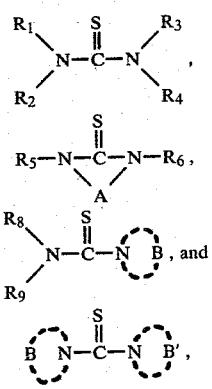

I, II, III, and IV wherein:

$R_1$, $R_2$, $R_3$ and $R_4$ are each selected from the group consisting of $C_1$-$C_6$ alkyl groups and $C_1$–$C_6$ substituted alkyl groups, provided, however, that (a) when any one of them has 5 or 6 carbon atoms, none of the others has more than 2 carbon atoms, and (b) when any two of them have 4 carbon atoms, none of the others has more than 2 carbon atoms;

$R_5$ and $R_6$ are each selected from the group consisting of H, a $C_1$–$C_4$ alkyl group, and a $C_1$–$C_4$ substituted alkyl group;

A is $—CH_2—X—CH_2—$;

X is a member selected from the group consisting of a carbon-carbon bond, $—CH_2—$, $—CH_2CH_2—$,

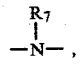

and —O—;

$R_7$ is a member selected from the group consisting of hydrogen, an alkyl group having 1 to 12 carbon atoms, a cycloalkyl group having 5 or 6 carbon atoms, and —O—;

$R_8$ and $R_9$ are each selected from the group consisting of $C_1$–$C_3$ alkyl groups, and $C_1$–$C_3$ substituted alkyl groups; B and B′ each have the formula $—CH_2—Y—CH_2—$, provided, however, that when one of B or B′ contains an oxygen atom in its ring, the other may not; and wherein Y is a member selected from the group consisting of a carbon-carbon bond, $-(CH_2)_n-$ where n is 1 to 3, $$-CH_2-\underset{\underset{R_1}{|}}{N}-CH_2-,$$

and $-CH_2-O-CH_2-$; and (2) subsequently washing the emulsion to remove any remaining thiourea derivative.

2. The process of claim 1 wherein the precipitation of the silver halide grains is followed by physical ripening of the grains.

3. The process of claim 2 wherein the thiourea derivative is present both during the precipitation and the ripening steps.

4. The process of claim 1 wherein the silver halide grains are precipitated in the presence of the thiourea derivative by the double jet method, which comprises the steps of gradually and simultaneously adding a solution of silver ion and a solution of halide ion or ions to a solution containing a protective colloid and said thiourea derivative, the rate of addition of each solution being controlled or programmed to maintain the silver ion concentration in the protective colloid solution at a desired value during the precipitation.

5. The process of claim 4 wherein the silver ion concentration is between a pAg of about 5 and 11, and the pH is between 4 and 7.

6. The process of claim 4 wherein during precipitation an additional halide ion is present in the protective colloid solution or is added simultaneously as a third solution to the protective colloid solution.

7. The process of claim 4 wherein the silver halide grains are silver bromide grains, and, after precipitation and ripening, the resulting emulsion is coagulated and washed with a soluble bromide solution to remove any of the remaining thiourea derivative and then washed further with water.

8. The process of claim 7 wherein the emulsion is then digested, sensitized or fogged, and coated.

9. The process of claim 1 wherein the silver halide grains are precipitated by the single jet precipitation method which comprises the addition of a soluble silver salt solution to a solution containing a protective colloid, a soluble halide salt, and a thiourea growth agent.

10. The process of claim 9 wherein after the initial addition of silver salt solution, the resulting emulsion is ripened.

11. The process of claim 9 wherein after the initial addition of silver salt solution the precipitation is continued by consecutively adding solution of halide ion and silver ion, the halide being the same halide initially present or a different halide ion.

12. The process of claim 9 wherein after precipitation and ripening, the emulsion is coagulated or precipitated, washed, digested, sensitized or fogged, and coated.

13. The process of claim 9 wherein during precipitation the thiourea derivative is present in the added silver salt solution.

14. The process of claim 6 wherein the precipitation is carried out in the presence of heavy metal ions.

15. The process of claim 1, wherein the thiourea derivative is dimethyl-imidazolidine-2-thione.

* * * * *